US008767993B2

(12) United States Patent
Kubin et al.

(10) Patent No.: US 8,767,993 B2
(45) Date of Patent: Jul. 1, 2014

(54) HOUSING FOR MICROPHONE ARRAYS AND MULTI-SENSOR DEVICES FOR THEIR SIZE OPTIMIZATION

(75) Inventors: Gernot Kubin, Graz (AT); Marián Képesi, Graz (AT); Michael Stark, Graz (AT)

(73) Assignee: Technische Universitat Graz, Graz (AT)

( * ) Notice: Subject to any disclaimer, the term of this patent is extended or adjusted under 35 U.S.C. 154(b) by 1030 days.

(21) Appl. No.: 12/742,277

(22) PCT Filed: Nov. 10, 2008

(86) PCT No.: PCT/EP2008/009454

§ 371 (c)(1),
(2), (4) Date: Sep. 7, 2010

(87) PCT Pub. No.: WO2009/062643

PCT Pub. Date: May 22, 2009

(65) Prior Publication Data

US 2010/0329478 A1 Dec. 30, 2010

(30) Foreign Application Priority Data

Nov. 12, 2007 (EP) ..... 07450197

(51) Int. Cl.

| | |
|---|---|
| ***H04R 1/20*** | (2006.01) |
| *H04R 9/08* | (2006.01) |
| *H04R 11/04* | (2006.01) |
| *H04R 17/02* | (2006.01) |
| *H04R 19/04* | (2006.01) |
| *H04R 21/02* | (2006.01) |

(52) U.S. Cl.
USPC ..... 381/345; 381/355; 381/360; 381/361

(58) Field of Classification Search
USPC ..... 381/67, 92, 150, 355, 356, 358, 361, 381/345, 360
See application file for complete search history.

(56) References Cited

U.S. PATENT DOCUMENTS

| | | | | |
|---|---|---|---|---|
| 4,268,912 | A * | 5/1981 | Congdon | 367/163 |
| 4,281,550 | A | 8/1981 | Erikson | |
| 4,580,451 | A | 4/1986 | Miwa et al. | |
| 6,438,238 | B1 * | 8/2002 | Callahan | 381/67 |
| 2006/0182300 | A1 * | 8/2006 | Schwartz | 381/355 |

FOREIGN PATENT DOCUMENTS

| | | |
|---|---|---|
| EP | 0110480 | 6/1984 |

OTHER PUBLICATIONS

'Life Size Phone' (http://www.lifesize.com/downloads/pdf/datasheet_phone.pdf, accessed on Sep. 27, 2007).
International Preliminary Report on Patentability, mailed Apr. 22, 2010, completed by EP ISA for PCT?EP2008/009454.

* cited by examiner

*Primary Examiner* — Matthew Eason
(74) *Attorney, Agent, or Firm* — Design IP

(57) ABSTRACT

A sensor system is located in an environment composed of a first medium, where waves propagate with a first phase velocity, the sensor system including at least one main enclosure and a sensor array with at least two sensors, said sensor array being arranged inside the main enclosure, wherein the space inside the main enclosure between the sensor array and the inner surface of the main enclosure is filled with a second medium, in which waves propagate with a second phase velocity, the second phase velocity being different from the first velocity.

14 Claims, 2 Drawing Sheets

HOUSING FOR MICROPHONE ARRAYS AND MULTI-SENSOR DEVICES FOR THEIR SIZE OPTIMIZATION

CROSS REFERENCE TO RELATED APPLICATIONS

The present application is a U.S. National Stage Application of PCT Application Serial No. PCT/EP2008/009454, filed on Nov. 10, 2008, which claims priority from European Patent Application Serial No. A EP074510197.4, filed on Nov. 12, 2007, both of which are incorporated by reference in their entireties.

FIELD OF THE INVENTION

The invention relates to a sensor system designed to be located in an environment composed of a first medium, where waves propagate with a first phase velocity, the sensor system comprising at least one main enclosure and a sensor array with at least two sensors, said sensor array being arranged inside the main enclosure.

BACKGROUND OF THE INVENTION

Sensor arrays, in particular with acoustic sensors, are of growing importance for a plurality of applications. In the field of mobile communication, for instance, where mobile phones are increasingly equipped with high power central processor units and powerful digital signal processors, a multitude of new features seems possible with advanced sensor arrays.

Audio conferencing devices rely on microphone arrays, hidden in the device, the arrays allowing for speaker tracking, speech enhancement, acoustic echo cancellation and everything needed for a hands-free conference call in a multi-speaker, noisy and reverberant environment. One example for such a device is the 'Life Size Phone' (http://www.lifesize.com/downloads/pdf/datasheet_phone.pdf, accessed on 27 Sep. 2007), an audio conference phone with a circular microphone array with 16 embedded microphones.

However, such devices are usually large and heavy and at the moment not suitable for use in mobile devices. This is due to the fact that commercially available sensor-arrays are up to now limited by their size and spatial sensitivity.

These two restrictions are however strongly dependent on physical properties of the signal of interest (wavelength). The size of a microphone array is defined by the frequency range of the signals to be processed and by the desired spatial resolution, thus not allowing the miniaturization of the size of those arrays. While the individual sensor elements/microphones of an array can be miniaturized, the geometrical distances among these sensor elements can not be reduced without affecting its spatial resolution capabilities for a given frequency range. Therefore, microphone arrays have not been included with mobile devices so far.

SUMMARY OF THE INVENTION

It is a goal of the present invention to provide a sensor array whose properties are independent of its dimensions while keeping the advantageous properties of larger or smaller arrays, like directional sensitivity and the like.

These aims are met by a sensor system as stated in the beginning, wherein the space inside the main enclosure between the sensor array and the inner surface of the main enclosure is filled with a second medium, in which waves propagate with a second phase velocity, the second phase velocity being different from the first velocity.

Depending on whether the second phase velocity is lower or higher than the first phase velocity, this solution allows for variable applications. By exploiting the advantages of different phase velocities in different media, small sensor arrays can be provided with properties of large sensor arrays and sensor arrays in general can be made sensible for high-frequency waves of any kind. In brief, the invention allows an optimization of sensor arrays, depending on the intended application. This is achieved with low cost and relatively small efforts compared to existing solutions. In principle, the solution according to the invention can be used for all kinds of waves which allows for a multitude of applications.

In one variant of the invention, the second medium is of such a kind that the second phase velocity of waves propagating in the second medium is lower than the first phase velocity of waves propagating in the first medium.

Thus, a considerable reduction of the size of such a sensor system can be realized by taking advantage of the difference of the phase velocity of waves in different media. The propagation speed of waves in different media can be used for the enhancement of cross-channel delay dependent on the wavelength under consideration. Since sensor arrays benefit mostly from the cross-channel delay between the sensors, the place where the speed of sound plays a big role is in the proximity of the sensors. In order to enhance the resolution of a sensor-array, the wavelength of the propagated signal needs to be reduced in comparison to the one in the original medium. Since the propagation speed and the wavelength of a sound are directly related, and the sensor array properties (e.g. direction dependent sensitivity) are directly related to the wavelength one can directly benefit from changing the medium. The wavelength reduction can be applied beneficially for two problems: The first is the size reduction of a sensor array by keeping constant the properties of the reference array. The second is the enhancement of important properties, like the sensitivity or the effective band-width of the array, by keeping the size unchanged.

In another variant of the invention, the second medium is of such a kind that the phase velocity of waves propagating in the second medium is higher than the first phase velocity of waves propagating in the first medium.

This allows for an inverse application of the principle of the invention: By taking advantage of a medium change, a sensor array can be used to analyze waves with a high frequency. For a correct functioning of such sensor arrays, the minimum distance between two neighbored sensors in principle is limited with one half of the wave length of the waves under consideration. Since waves with a high frequency have a very small wavelength which may be too small for allowing sensors to be arranged in the necessary distance, a medium change may allow for this condition to be met.

In an advantageous variant of the invention, the sensors used in the sensor array are acoustic sensors, preferably microphones. The minimum number of microphones used is two, however, for obvious reasons the advantageous properties of the invention increase with the number of acoustic sensors used. In principle there are no restrictions on the type of microphone used, as long as its size allows for a minimization/maximization of the sensor system as a whole. The spacing between the microphones can be both linear and non-linear, which means that the distances may be different or the same throughout the array.

In principle it is possible to use multiple separate MEMS-circuits (Micro-electro-mechanical Systems) for the acoustic sensors. Here, one MEMS-circuit is considered as a single array element even if itself may be composed of several transducers. These microphones feature a very small size and have a low power consumption while maintaining a very good signal quality. Thus, by virtue of this solution a further downsizing of the sensor system is feasible.

In most of the cases the first medium the sensor system is located in will be air. However, the application of the sensor system is not restricted to situations where the first medium is air. The first medium might as well be a liquid like water, a composite material or a solid, provided the phase velocity of a wave propagating in the second medium is different to the phase velocity in the first medium. This allows for different application of the sensor system according to the invention, like geodesic measurements (earth quake measurements), underwater measurements (fish tracking and submarine localization) and biomedical applications.

In case a minimization of the sensor array is intended and air is used as a first medium, cool air could be used as a second medium in principle, i.e. the air acting as the second medium has to be considerably cooler than the air surrounding the sensor system enclosure.

However, such an arrangement is not very convenient, since the temperature difference between the two media has to be very high to achieve a sufficient decrease of the propagation speed of propagating waves. Thus, the second medium might be a gaseous medium or a material with a composite structure or a liquid or a solid with a second phase velocity that is smaller or lager than the phase velocity in air. In each of said media, the second phase velocity of a propagating wave has to be different than the first phase velocity of a wave propagating in the first medium.

Possible gases are Argon (Ar), Krypton (Kr), Xenon (Xe), Sulfur Hexafluoride ($SF_6$) and Carbon Dioxide ($CO_2$), to name only some of a couple of possible gases, where the second phase velocity is lower than the first phase velocity.

If the second medium is a composite, materials such as sand are considered to be used for that purpose, but also plastics with a similar structure and granularity as sand might be appropriate. Such materials can reduce the phase velocity of waves sufficiently. Also, the consequences of a leakage in the main enclosure are negligible compared to a gaseous medium.

The second medium might also be a liquid like water, oil or alcohol. Possible solids are acrylic glass, rubber or plastics. Rubber could be used when it is intended to have a second medium with a higher phase velocity.

For the sake of completeness it has to be mentioned that the choice of the second medium always depends on the first medium and whether the second phase velocity of propagating waves should be lower or higher than the first phase velocity.

There are various possibilities for the construction of the main enclosure of the sensor system. In a general layout it might be substantially ball-shaped. This allows for an optimal response of the sensor system, regardless of which direction the propagating waves come from. However, such a shape necessitates some sort of rack to keep the sensor system in place. Thus, in another embodiment the enclosure has a substantially hemispherical shape. However, the shape is not restricted to spherical shape, also elliptical or half-elliptical shapes are possible. Generally speaking, there are no restrictions as to the shape of the enclosure, but whichever shape is chosen, care has to be taken that shape dependent artifacts and diffractions are negligible.

Regardless of the design of the main enclosure, additional layers of enclosures might be provided around a first enclosure. Each of the additional enclosures may serve a specific purpose: The outermost enclosure improves the stability of the system, whereas one of the interior enclosures enhances the leak-tightness of the system, to name only some of many possible purposes. In principle, the layers of enclosures stick together. In one embodiment of the invention, the space between said enclosures may be filled with air. Thus, a leakage of the main enclosure does not immediately lead to an elusion of the second medium.

The additional layers of enclosures may be provided with security sensors. Thus, in case of a partial damage of one of the enclosures the sensors may react and can initiate counter measures to prevent a leakage of the medium that is located inside the enclosures. There is a number of sensors that can be used for that purpose, e.g. semiconductor gas sensors. There exist sensors with different sensitivity (reacting on different concentrations of a specified gas). Their working principle is based on a chemical reaction with the detected/leaking gas which changes the physical properties of the sensor and in doing so sends a signal.

The invention will be best understood from the following description when read in conjunction with the accompanying drawings.

BRIEF DESCRIPTION OF THE DRAWINGS

In the following, the present invention is described in more detail with reference to the drawings, which show.

DETAILED DESCRIPTION OF THE INVENTION

Figure 1:
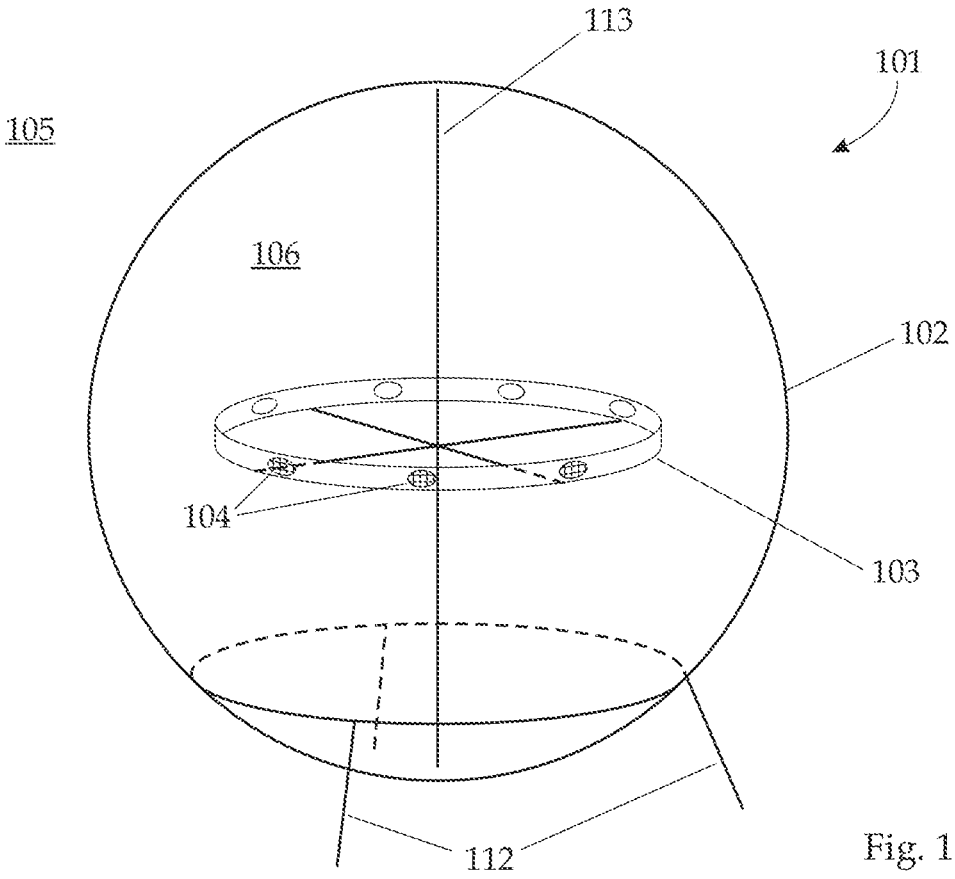
FIG. 1 a schematic view of a sensor system according to the invention, with a ball-shaped main enclosure, FIG. 2 another embodiment of a sensor system where the main enclosure has a hemispherical shape, FIG. 3*a* a plan view of yet another embodiment of a sensor system with an elliptical shape, FIG. 3*b* a sectional view of the embodiment of FIG. 3 along the line A-A, FIG. 4 a detail of a sectional view of a sensor system comparable to the one depicted in FIG. 1 with a number of interleaved enclosures.
Figure 2:
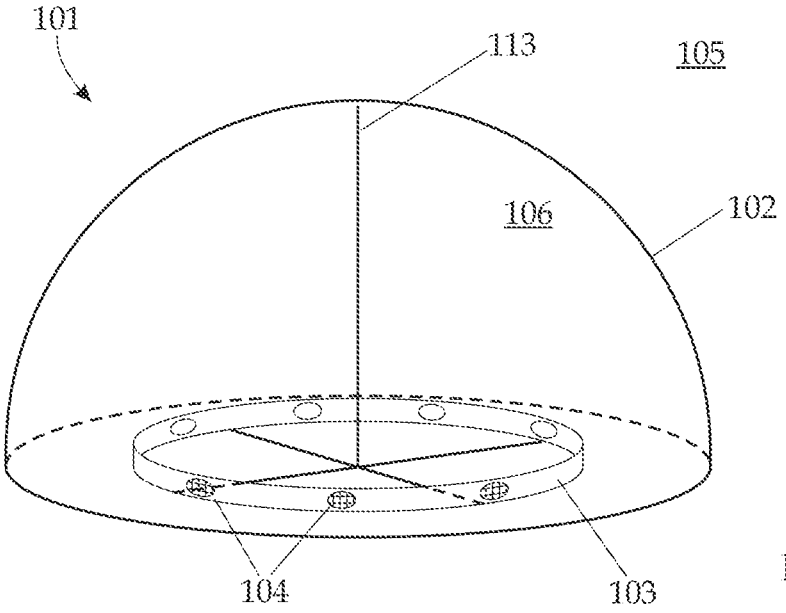

FIG. 1 shows one possible embodiment of a sensor system 101 according to the invention. It comprises a main enclosure 102 that is mounted on a rack 112. The main enclosure 102 has a spherical shape, FIG. 2 shows an embodiment with a hemispherical main enclosure 102. In the case of FIG. 1, the rack 112 is a tripod, but this is only one of many possible solutions any expert would easily come up with. The sensor system 101 of FIG. 2 can be placed on any flat surface, thus no rack 112 is needed.

Figure 3A:
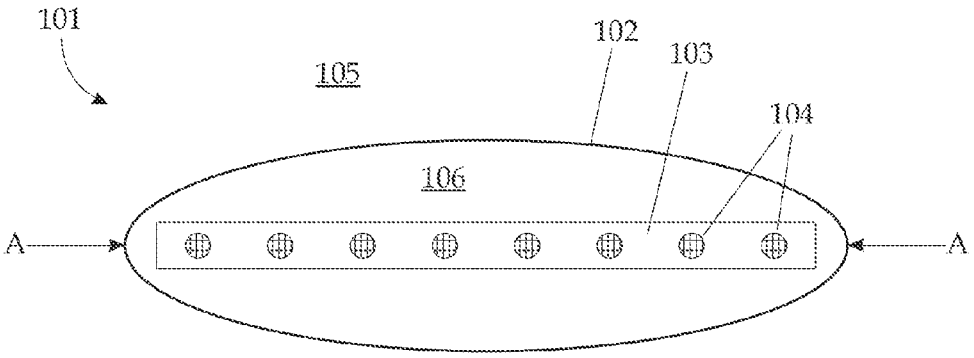
Figure 3B:
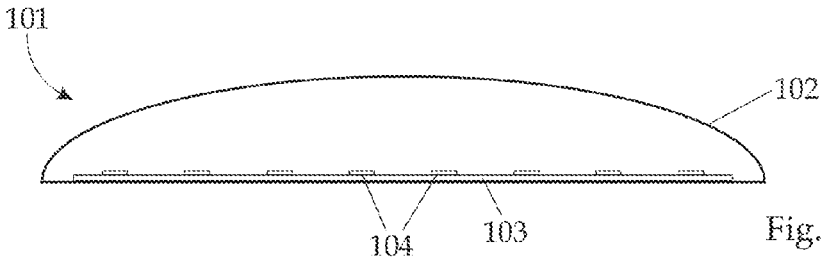

Inside the main enclosure 102, there is a circular sensor array 103 with a plurality of sensors. In principle, a plurality of different sensors can be used. In the embodiment of the invention discussed here, the sensors are microphones 104. The minimum number of microphones 104 for the sensor system 101 to work as intended by the invention is two; however, the embodiments in FIGS. 1 and 2 show seven microphones 104. For obvious reasons, there is no limit for the number of microphones 104 used besides weight, spatial constraints and the processing power of the device used to process the signals. The sensor array 103 is held in place by a support structure 113. For the sake of completeness it is mentioned that the circular form of the sensor array 103 and the design of the support structure 113 in FIGS. 1 and 2 is only one of many different embodiments. FIGS. 3*a* and 3*b* show yet another possible arrangement: The main enclosure 102 has an elliptical shape and the sensor array 103 is a linear array with eight microphones 104. FIG. 3*a* shows a ground view of such an embodiment, whereas FIG. 3*b* depicts a cross-section along the line A-A in FIG. 3*a*.

Whichever arrangement is chosen for the main enclosure 102 and/or the sensor array 103, the following applies for all possible embodiments: The environment of the sensor system 101 is composed of a first medium 105. Waves propagating in said first medium 105 move with a first phase velocity. The space between the main enclosure 102 and the sensor array 103 inside the sensor system 101 is filled with a second medium 106. The second phase velocity of waves propagating in the second medium 106 is different from the first phase velocity. Depending on the intended use of the sensor system 101, the second phase velocity may be higher or lower than the first phase velocity. In the case presented here, both media 105, 106 are chosen in such a way that propagating waves, e.g. sound waves, slow down considerably when crossing the boundary between the first medium 105 and the second medium 106, thus moving at a lower phase velocity in the second medium 106 than in the first medium 105. Thus, the sensor array 103 can be minimized. Naturally, also the opposite case where the second medium 106 is chosen such that propagating waves speed up and have a higher phase velocity is thinkable. This version would allow for the sensor array 103 to be optimized for the intended use. In sensor systems 103 where the second medium 106 provides for a higher phase velocity of waves than the first medium 105 the resolution of the system for waves with a higher frequency would be better and thus allow for a sound analysis of the whole frequency spectrum.

In the majority of cases for the minimization of the size of the array, the first medium 105 will be in a gaseous state; most likely it will be air. However, the invention is not restricted to such situations; in principle, the first medium 105 can be any medium in any physical condition, as long as the demand is met that the phase velocity of a propagating wave is higher than in the second medium 106.

In theory, the second medium 106 inside the main enclosure 102 can be air as well. In that case, in order for waves to slow down inside the main enclosure 102, the air inside the main enclosure 102 has to be much cooler than the air in the surrounding area of the sensor system 101. To give an example: To halve the speed of the propagating waves inside the sensor system 101, the temperature difference between first medium 105 and second medium 106 has to be 283,35° C. With the temperature of the first medium 105 being 20° C., the second medium 106 would have to be cooled to a temperature of −263.35° C., which seems rather inconvenient.

Therefore, it is better, respectively more convenient, to use different media 105, 106 inside and outside of the main enclosure 102. Advantageously, inside the main enclosure 102 a medium is used where waves move with a considerably lower phase velocity than in the medium surrounding the enclosure. Possible alternatives for the second medium 106 are gaseous, liquid, solid or composite materials.

Applicable gaseous media are Argon (Ar), Krypton (Kr), Xenon (Xe), Sulfur Hexafluoride ($SF_6$) and Carbon Dioxide ($CO_2$). It goes without saying that theses gases constitute only a small selection of a multitude of usable gases. The same applies for composite, solid and liquid media—rubber, sand, plastic pellets and alcohol are given here as examples, however depending on the intended use of the sensor system 101, a multitude of other media can be used.

When a gaseous medium is used as second medium 106, attention should be paid to the construction of the main enclosure 102: The material of the main enclosure 102, e.g. a membrane, must ensure that the first medium 105 and the second medium 106 are well separated and no diffusion can occur. In order to ensure long term stability, a special plastic/membrane with a certain thickness not getting porous over time has to be used. A possible choice for the material of the main enclosure 102 might be a balloon.

Figure 4:
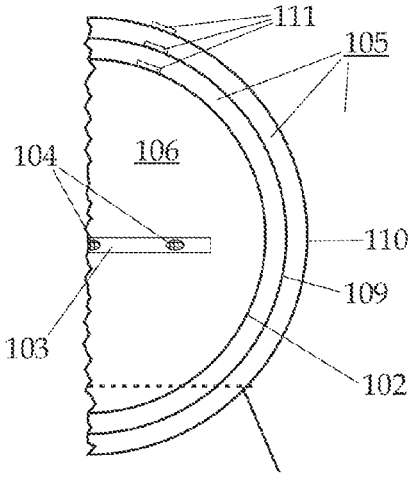

For safety reasons, additional layers of enclosures could be used. FIG. 4 shows a detail of a cross section of an embodiment with a shape similar to the one depicted in FIG. 1, where the main enclosure 102 is surrounded by a second enclosure 109 and a third enclosure 110. Thus, the second medium 106 does not effuse in the environment in case of a leakage of the main enclosure 102. The space between the layers of enclosures 102, 109, 110 might be filled with the same medium the environment consists of, i.e. the first medium 105. Additionally, the layers of enclosures 102, 109, 110 might be equipped with security sensors 111 configured to alarm in case of a leakage of any of the enclosures, e.g. pressure sensors or some sort of leakage sensors. Also, security sensors 111 can be used that are triggered by an elevated concentration of a gas inside the enclosure.

For liquid media, the requirements are less strict. However, attention has to be paid to the leak tightness of the main enclosure 102, since a liquid might affect the functional capability of any device the sensor system 101 might be build in. Also the transition of the propagating wave from the first 105 to the second medium 106 might cause diffractions. The design of the boundary between the two media 105, 106 thus has to be carried out more carefully.

The second medium 106 can also be a composite material, e.g. sand or plastic pellets. Here, the main enclosure 102 has to ensure that the material is surrounding the entire sensor system 103 properly. For that purpose, a fine mesh made of metal or plastic having a fixed shape might be sufficient.

The optimization of sensor systems 101 as proposed allows for a range of new applications, like a combination of three different sensor arrays: One is a minimized version with an enclosure with a second medium 106 having a lower phase velocity than the first medium 105, one is a 'normal' version without any media-changes applied or enclosures used, and one is a maximized version with a second medium 106 having a higher phase velocity than the first medium 105. With such an arrangement it is possible to capture the whole audio frequency range of acoustic signals with high resolution. The minimized array captures the low frequency range, the 'normal' array captures the middle frequency range and the high frequency range is captured by the maximized array.

For the sake of completeness it has to be mentioned that when propagating waves cross the main enclosure 102 and enter from the first medium 105 in the second medium 106, the main enclosure 102 introduces distortions to the propagating waves. These distortions, however, can be reduced by applying post processing techniques such as filtering techniques and linearization. Though such measures can be used to ameliorate the signal gained by the sensor array 103, the influence of the main enclosure 102 has to be taken into account when constructing a sensor system 101 according to the invention.

We claim:

1. A sensor system designed to be located in an environment composed of a first medium, where waves propagate with a first phase velocity, the sensor system comprising at least one main enclosure and a sensor array with at least two sensors, said sensor array being arranged inside the main enclosure, wherein the first medium is air and the space inside the main enclosure between the sensor array and the inner surface of the main enclosure is filled with a second medium, in which waves propagate with a second phase velocity, wherein the second medium is of such a kind that the second phase velocity of waves propagating in the second medium is lower than the first phase velocity of waves propagating in the first medium, wherein the sensors of the sensor array are acoustic sensors, wherein MEMS (Micro-electro-mechanical Systems) microphones are used for the acoustic sensors.

2. The sensor system of claim 1, wherein the second medium is a gaseous medium or a material with a composite structure or a liquid or a solid with a second phase velocity that is smaller or larger than the phase velocity in air.

3. The sensor system of claim 1, wherein the main enclosure has a substantially spherical shape.

4. The sensor system of claim 1, wherein the main enclosure has a substantially hemispherical shape.

5. The sensor system of claim 1, wherein additional layers of enclosures are provided around a main enclosure.

6. The sensor system of claim 5, wherein the space between the enclosures is filled with air.

7. The sensor system of claim 5, wherein the additional layers of enclosures are provided with security sensors.

8. A sensor system designed to be located in an environment composed of a first medium, where waves propagate with a first phase velocity, the sensor system comprising at least one main enclosure and a sensor array with at least two sensors, said sensor array being arranged inside the main enclosure, wherein the first medium is air and the space inside the main enclosure between the sensor array and the inner surface of the main enclosure is filled with a second medium, in which waves propagate with a second phase velocity, wherein the second medium is of such a kind that the second phase velocity of waves propagating in the second medium is lower than the first phase velocity of waves propagating in the first medium, wherein additional layers of enclosures are provided around a main enclosure, wherein the sensors of the sensor array are acoustic sensors.

9. The sensor system of claim 8, wherein microphones are used for the acoustic sensors.

10. The sensor system of claim 8, wherein the second medium is a gaseous medium or a material with a composite structure or a liquid or a solid with a second phase velocity that is smaller or larger than the phase velocity in air.

11. The sensor system of claim 8, wherein the main enclosure has a substantially spherical shape.

12. The sensor system of claim 8, wherein the main enclosure has a substantially hemispherical shape.

13. The sensor system of claim 8, wherein the space between the enclosures is filled with air.

14. The sensor system of claim 8, wherein the additional layers of enclosures are provided with security sensors.

* * * * *